United States Patent [19]

Cuscovitch

[11] 4,261,104

[45] Apr. 14, 1981

[54] HOLDER FOR DETACHABLE BLADES

[76] Inventor: John F. Cuscovitch, 42 Woodbridge Ave., East Hartford, Conn. 06108

[21] Appl. No.: 53,240

[22] Filed: Jun. 29, 1979

[51] Int. Cl.[3] ..... B26B 1/00

[52] U.S. Cl. ..... 30/330; 30/331

[58] Field of Search ..... 30/330, 331

[56] References Cited

U.S. PATENT DOCUMENTS

| | | | |
|---|---|---|---|
| 1,064,545 | 6/1913 | Rote | 30/331 |
| 2,463,682 | 3/1949 | Doniger | 30/331 |
| 2,478,668 | 8/1949 | Shepard et al. | 30/330 |
| 3,377,703 | 4/1968 | Longobardi | 30/330 |
| 3,604,113 | 9/1971 | Cuscovitch | 30/331 |
| 3,927,473 | 12/1975 | Braginetz | 30/331 |

FOREIGN PATENT DOCUMENTS

| | | | |
|---|---|---|---|
| 126593 | 5/1919 | United Kingdom | 30/330 |

*Primary Examiner*—Othell M. Simpson
*Assistant Examiner*—J. T. Zatarga
*Attorney, Agent, or Firm*—McCormick, Paulding & Huber

[57] ABSTRACT

A holder for detachable, apertured blades has two body sections connected intermediate the ends thereof for pivotal movement between open and closed positions. A blade received within a recess at one end of one of the body sections, when the holder is in open position, is retained on a projection which extends through and beyond the recess at the one end. A latching member mounted in fixed position on the other of the sections cooperates with the projection to interlock the blade in the holder when the body sections are pivoted to closed position. A detent at the free end of the handle portion of the holder releasably retains the two body sections in closed position.

7 Claims, 8 Drawing Figures

HOLDER FOR DETACHABLE BLADES

BACKGROUND OF THE INVENTION

This invention relates in general to cutting tools and deals more particularly with an improved holder for detachable blades suitable for use as a general purpose cutting tool and particularly adapted for use as a carpet installation tool. Holders for detachable blades are well known in the art and such a blade holder is illustrated and described in my U.S. Pat. No. 3,604,113, issued Sept. 4, 1971. The blade holder of my aforementioned U.S. patent has two elongated body portions which cooperate in mating engagement to define a longitudinally extending handle portion and a blade retaining portion which extends forwardly from the handle portion. The two body sections are connected at the rear end of the handle portion to pivot relative to each other and to an open position wherein a blade may be attached to or removed from the holder. A latching member pivotally connected to the forward end of one of the sections carries a latch element which is radially spaced from the pivot axis of the latching member. The pivoted latching member cooperates in latching engagement with a blade receiving projection on the other section spaced rearwardly of its forward end. When the handle is in its closed position the latching member retains a blade in interlocked relation with the holder so that a portion of the blade extends forwardly of the holder. Because of the pivotal arrangement of the latching member, at the forward or working end of the holder, the blade receiving projection, which extends through an aperture in the blade, must be spaced a substantial distance rearwardly of the latching member pivot axis. This arrangement restricts blade projection. Although the blade may be reversible, only about one-third of its cutting edge can be exposed beyond the holder. Thus, a central portion of each blade edge remains unused even when the blade is sufficiently worn to require replacement. Situations are encountered where a longer cutting edge is desired, or, in fact, required. Further, the latch member being pivotally connected to only one of the body sections by a relatively short pivot pin tends to loosen from repeated use and generally lacks desired blade retention capability. In my earlier construction, exemplified by the aforesaid patent, a rivet retains the two body sections in assembly and also serves as a pivot pin. This riveted construction is prone to binding and may make it difficult to open and close the holder.

The present invention is concerned with the aforesaid problems.

SUMMARY OF THE INVENTION

In accordance with the present invention an improved holder for detachable blades is provided which has two body sections pivotally connected for movement between open and closed positions and which cooperate in closed position to define an elongated handle portion and a blade receiving portion projecting from one end of the handle portion and terminating at the tip. A latch member disposed in fixed position near the tip of one of the sections cooperates in latching engagement with a blade retaining projection carried by the other of the body sections and projecting through and beyond a blade receiving recess in the forward end of the blade receiving portion thereof. The latch member cooperates in latching engagement with the blade retaining projection when the holder is in its closed position to releasably retain an aperture blade in interlocked relation with the holder.

DETAILED DESCRIPTION OF PREFERRED EMBODIMENT

Figures 1, 2, 3, 4, 5, 6, 7, 8:
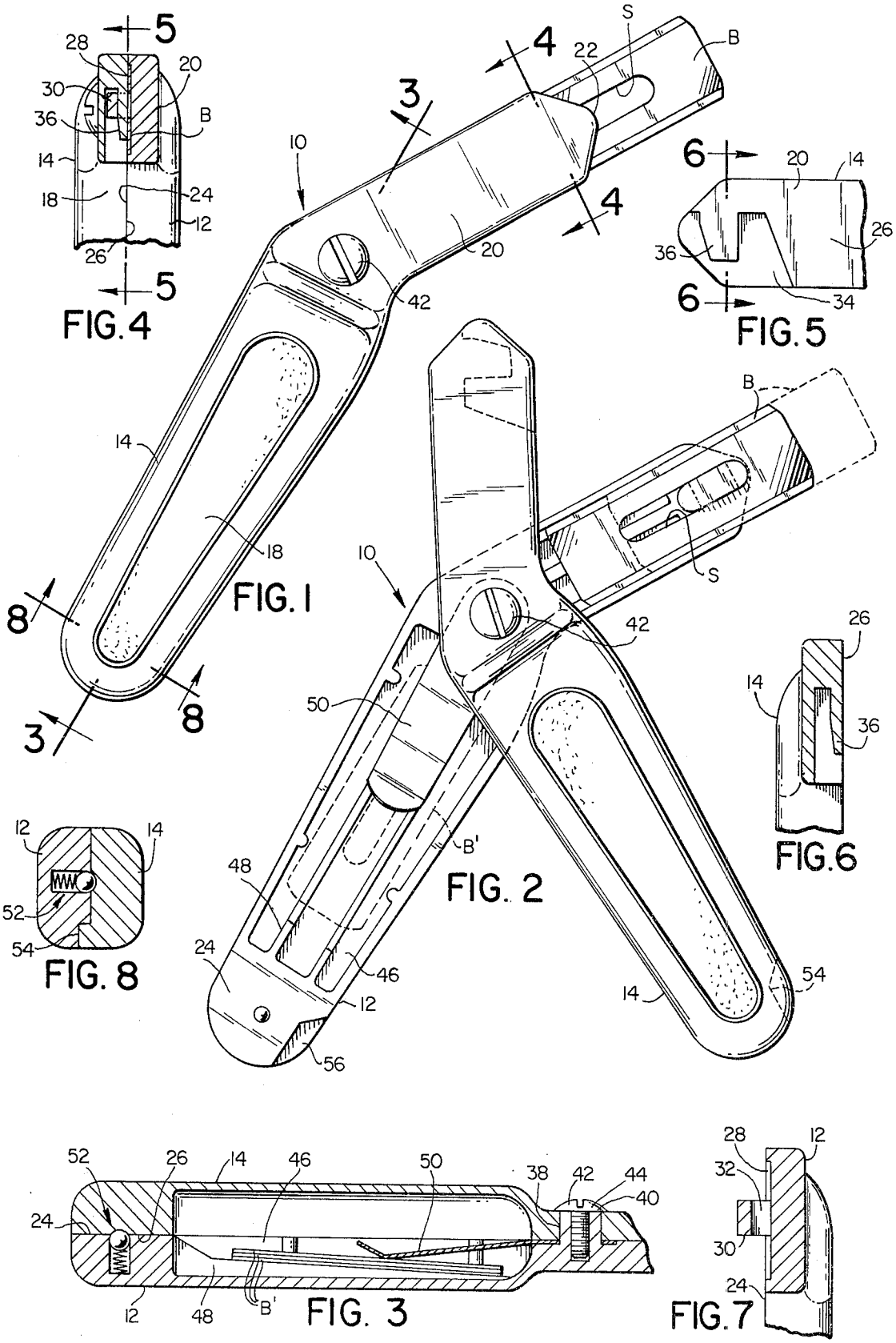
FIG. 1 is a side elevational view of a holder embodying the present invention shown with a detachable blade secured therein.
FIG. 2 is a side elevational view of the holder of FIG. 1 shown in open position.
FIG. 3 is a fragmentary sectional view taken generally along the line 3—3 of FIG. 1.
FIG. 4 is a somewhat enlarged sectional view taken along the line 4—4 of FIG. 1.
FIG. 5 is a fragmentary sectional view taken along the line 55 of FIG. 4.
FIG. 6 is a somewhat enlarged sectional view similar to FIG. 4 but shows only one body section of the holder.
FIG. 7 is a view similar to FIG. 4 and shows the other body section of the holder.
FIG. 8 is a somewhat enlarged fragmentary sectional view taken along the line 8—8 of FIG. 1.

Turning now to the drawing, a holder for detachable blades embodying the present invention is indicated generally by the reference numeral 10. The holder 10 is shown in FIG. 1 with an apertured blade B releasably retained therein. The illustrated holder and blade assembly is suitable for use as a general purpose cutting tool, but is particularly adapted for use as a carpet installation tool. The illustrated blade B has two sharpened opposite edges and an elongated aperture or slot indicated at S and may be reversably positioned within the holder, as will be hereinafter further evident.

The holder 10 generally comprises two body or half sections indicated at 12 and 14, respectively, connected together to pivot about an axis 16 between open or blade receiving positions, such as shown in FIG. 2, and a closed or blade retaining position, as shown in FIG. 1. In the closed position the body sections 12 and 14 cooperate to define a longitudinally extending handle portion 18 and a blade retaining portion 20 which extends forwardly from the handle portion and terminates at a tip 22.

Considering the holder 10 in further detail, the body sections 12 and 14 have opposing inner surfaces indicated at 24 and 26, respectively, which are disposed in mating engagement when the holder 10 is in its closed position and as best shown in FIGS. 3 and 4. The body section 12 has a shallow forwardly opening recess 28 in its blade retaining portion. The depth of the recess 28 is approximately equal to the thickness of the blade B and its width approximately equal to the width of the blade. A blade mounting projection 30, integrally formed on the body section 12 at the forward end of the blade retaining portion projects inwardly beyond the recess 28, as best shown in FIGS. 4 and 7. The projection 30 is disposed immediately adjacent the tip 22, extends rearwardly in the direction of the handle portion 18, and is shaped to complement at least a portion of the slot S. The blade mounting projecting 30 is preferably sized to allow a blade B to move forwardly and rearwardly within the recess 28 between full and broken line positions when the holder is in its open position, as shown in FIG. 2, so that projection of the blade beyond the tip 22 may be adjusted, as desired. The projection 30 has a length dimension less than the length dimension of the slot S and also a slot 32 which extends transversely through it in a plane generally parallel to the plane of the blade B. When the blade is positioned within the recess 24 and engaged with the projection 30 the slot 32 is exposed inwardly beyond the blade, as best shown in FIG. 4.

The other body section 14 is similar in some respects to the handle section 12 but of opposite hand. It is formed with a cavity 34 in the region of its tip which opens through the surface 26, through the tip, and laterally outwardly through one side of its blade receiving portion 20. The cavity 34 is arranged to receive the projection 30 when the body sections 12 and 14 are pivoted to closed position. A latch member 36 disposed in fixed position on the body section 12 near its forward end is adapted to be received within the slot 32 when the holder is in its closed position. Preferably, the latch member 36 is formed with a slight taper which converges toward its free end, as viewed in FIG. 6. This taper aids in guiding the latch member 36 into the slot 32 and provides for a slight wedging action between the inner surface of a blade B and an opposing wall of the slot 32 so that the blade is securely retained within the recess 22. Preferably, and as shown, the latch member 36 comprises an integral part of the body section 12, however, it may also be formed as a separate member and attached in fixed position to the body section.

The body sections 12 and 14 are connected for pivotal movement about the axis 16 by a generally cylindrical boss 38 which is integrally formed on the handle section 12 and extends through a cylindrical hole in the other body section 14. The boss 38 has a radial bearing surface 40 at its outer end which is disposed a slight distance outwardly beyond the associated outer surface of the body section 14 when the two body sections are connected in assembly. The body sections are retained in assembly by a fastener 42 which is threaded into the boss 38, substantially as shown in FIG. 3. The fastener has an enlarged head 44 which is somewhat larger than the bearing surface 40 and which engages the latter bearing surface. Thus, the two body sections 12 and 14 are retained in assembly for free pivotal movement relative to each other without risk of binding.

Preferably, at least one of the body sections is hollow to provide storage space for one or more spare blades. The illustrated holder 10 has a blade storage compartment 46 formed in its body section 12. A pair of generally parallel ribs 48, 48 integrally formed on the body section 12 project into the storage compartment 46 and extend longitudinally thereof. As viewed in FIG. 3, the ribs 48, 48 are inclined outwardly from the rear end of the compartment or toward the outer surface of the handle portion 18 and in a forward direction. The ribs are adapted to support one or more spare blades, such as the blade B′ indicated by broken lines in FIG. 2. The inclined arrangement of the ribs support the extra blades at the convenient angle to facilitate easy removal in a rearward direction toward the free end of the body section 12. A flat spring 50, has one end received on the boss 38 and within an associated recess in the body section 12, substantially as shown in FIG. 3. The free end of the spring 50 is biased toward the ribs 48, 48 and serves to firmly hold spare blades in substantially fixed position within the compartment 46 so that the blades will not rattle within the holder 10 or become nicked or otherwise damaged by movement therein.

The illustrated holder 10 further includes a ball detent mechanism, indicated generally at 52, associated with the handle portion 18 and located proximate its free end for releasably retaining the body sections 12 and 14 in closed position. As shown in FIGS. 2 and 3, the detent mechanism comprises a spring projected ball carried by the body section 12 and adapted for engagement within an associated opposing recess in the body section 14 when the holder 10 is in its closed position.

It will be evident that cooperation of the latch member 36 with the blade retaining projection 30 prevents the body section 14 from being rotated in a clockwise direction relative to the body section 12 and from its closed position of FIG. 1. However, if desired, an additional limit stop may be provided at the free end of the handle to prevent possible damage to the latch member 36 and/or the blade retaining projection 30. The limit stop, best shown in FIG. 8, comprises a projection 52 on the body section 14 which extends beyond the surface 26 and which is received in a corresponding recess 56 in the body section 12 when the holder 10 is in its closed position. It will be evident in normal use gripping the handle will tend to retain the holder in its closed position.

I claim:

1. A holder for a detachable blade having an elongated slot therein, said holder comprising an elongated handle portion and a blade retaining portion extending from said handle portion and terminating at a tip, said holder including two relatively movable body sections having opposing surfaces, pivot means connecting said body sections for pivotal movement between open and closed positions about an axis extending transversely of said holder proximate the junction of said handle and blade retaining portions, said body sections having opposing surfaces disposed in mating engagement in said closed position, one of said body sections having a blade receiving recess in its blade retaining portion and opening through its opposed surface and through its tip, an elongated blade retaining projection carried by said one body section and disposed immediately adjacent said tip for complementing an associated portion of the slot and having a length dimension less than the length dimension of the slot, said blade retaining projection extending within said blade receiving recess from said tip in the direction of said handle portion and projecting through and beyond said blade receiving recess, said blade retaining projection having a latch receiving opening therein, the other of said body sections having a cavity in its blade retaining portion opening through its opposing surface and transversely outwardly through one side of its blade retaining portion for receiving said blade retaining projection when said holder is in its closed position, and a latch member connected to said other half section and extending into said cavity in said closed position, said latch member being engageable with said blade retaining projection within said latch receiving opening when said holder is in its closed position to interlock said blade with said holder, said blade retaining projection and said latch member being substantially wholly concealed within said blade retaining portion of said holder when said holder is in its closed position.

2. A holder for a detachable blade as set forth in claim 1 wherein said pivot means comprises a generally cylindrical boss carried by one of said body sections and extending outwardly through a generally cylindrical hole in the other of said body sections and a fastener threadably engaged in said boss and having a head larger than the outer end of said boss engaged with said outer boss.

3. A holder for a detachable blade as set forth in claim 1 wherein said holder includes means associated with said handle portion for releasably retaining said body sections in said closed position.

4. A holder for a detachable blade as set forth in claim 3 wherein said releasably retaining means is disposed proximate the free end of said handle portion.

5. A holder for a detachable blade as set forth in claim 1 wherein said holder includes stop means other than said latch member for preventing pivotal movement of said one body section from said closed position and in one direction relative to said other body section.

6. A holder for a detachable blade as set forth in claim 5 wherein said stop means comprises coengageable abutment surfaces on said body sections.

7. A holder for a detachable blade having an elongated slot therein, said holder comprising an elongated handle portion and a blade retaining portion extending from said handle portion in inclined relation to the longitudinal axis of said handle portion and terminating at a tip, said holder including two relatively movable half sections having opposing surfaces, pivot means connecting said half sections for free pivotal movement between open and closed positions about an axis extending transversely of said holder proximate the junction of said handle and blade retaining portions and including an integral generally cylindrical boss extending transversely outwardly from one of said half sections and through a cylindrical hole in the other of said half sections and a fastener threadably engaged in said boss and including a diametrically enlarged head having a diameter larger than the diameter of the outer end of said boss and the outer end of said hole, said half sections having opposing surfaces disposed in mating engagement in said closed position, one of said half sections having the blade receiving recess in its blade retaining portion and opening through its opposed surface and through its tip, an elongated blade retaining projection carried by said one half section and disposed immediately adjacent said tip for complementing an associated portion of the slot and having a length dimension less than the length dimension of the slot, said blade retaining projection extending within said blade receiving recess from said tip in the direction of said handle portion and projecting through and beyond said blade receiving recess, said blade retaining projection having a latch receiving opening therein, the other of said half sections having a cavity in its blade retaining portion opening through its opposing surface and transversely outwardly through one side of its blade retaining portion for receiving said blade retaining projection when said holder is in its closed position, a generally wedge shaped latch member integrally connected to said other half section and extending into said cavity, said latch member being engageable with said blade retaining projection within said latch receiving opening when said holder is in its closed position to interlock said blade with said holder, said blade retaining projection and said latch member being substantially wholly concealed within said blade retaining portion when said holder is in its closed position, means disposed proximate the free end of said handle portion for releasably retaining said body sections in said closed position, and means other than said latch member for preventing pivotal movement of one of said body sections in one direction and relative to the other of said body sections from said closed position.

* * * * *

UNITED STATES PATENT AND TRADEMARK OFFICE

CERTIFICATE OF CORRECTION

PATENT NO. : 4,261,104

DATED : April 14, 1981

INVENTOR(S) : John F. Cuscovitch

It is certified that error appears in the above-identified patent and that said Letters Patent are hereby corrected as shown below:

Column 1, line 12, "Sept. 4, 1971" should be --Sept. 14, 1971--.

Column 2, line 64, "projecting 30" should be --projection 30--.

Column 5, line 3, "boss" should be --end--.

Signed and Sealed this

Fourth Day of August 1981

[SEAL]

Attest:

GERALD J. MOSSINGHOFF

Attesting Officer

Commissioner of Patents and Trademarks